US010560767B2

(12) United States Patent
Grzeczynski et al.

(10) Patent No.: US 10,560,767 B2
(45) Date of Patent: Feb. 11, 2020

(54) SOUND GENERATOR, A SHIELDING AND A SPOUT

(71) Applicant: Sonion Nederland B.V., Hoofddorp (NL)

(72) Inventors: Tomasz Grzeczynski, Hoofddorp (NL); Michele Colloca, Hoofddorp (NL); Lars Wijsman, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/120,931

(22) Filed: Sep. 4, 2018

(65) Prior Publication Data

US 2019/0075380 A1 Mar. 7, 2019

(30) Foreign Application Priority Data

Sep. 4, 2017 (EP) ..... 17189257

(51) Int. Cl.
*H04R 25/00* (2006.01)
*H04R 1/02* (2006.01)
*H04R 1/28* (2006.01)

(52) U.S. Cl.
CPC ..... *H04R 1/025* (2013.01); *H04R 1/2857* (2013.01)

(58) Field of Classification Search
CPC ..... H04R 1/025; H04R 1/2857
See application file for complete search history.

(56) References Cited

U.S. PATENT DOCUMENTS

| | | | | |
|---|---|---|---|---|
| 6,738,488 | B1 * | 5/2004 | Baker | H04R 25/654 381/322 |
| 6,788,796 | B1 | 9/2004 | Miles | |
| 6,831,577 | B1 | 12/2004 | Furst | |
| 6,853,290 | B2 | 2/2005 | Jorgensen | |
| 6,859,542 | B2 | 2/2005 | Johannsen | |
| 6,888,408 | B2 | 5/2005 | Furst | |
| 6,914,992 | B1 | 7/2005 | van Halteren | |
| 6,919,519 | B2 | 7/2005 | Ravnkilde | |
| 6,930,259 | B1 | 8/2005 | Jorgensen | |
| 6,943,308 | B2 | 9/2005 | Ravnkilde | |
| 6,974,921 | B2 | 12/2005 | Jorgensen | |
| 7,008,271 | B2 | 3/2006 | Jorgensen | |
| 7,012,200 | B2 | 3/2006 | Moller | |
| 7,062,058 | B2 | 6/2006 | Steeman | |
| 7,062,063 | B2 | 6/2006 | Hansen | |
| 7,072,482 | B2 | 7/2006 | Van Doom | |
| 7,088,839 | B2 | 8/2006 | Geschiere | |
| 7,110,560 | B2 | 9/2006 | Stenberg | |

(Continued)

FOREIGN PATENT DOCUMENTS

| | | | |
|---|---|---|---|
| CN | 104394493 | A | 3/2015 |
| EP | 2375784 | A2 | 10/2011 |
| WO | WO 2014/090282 | A1 | 6/2014 |

OTHER PUBLICATIONS

European Search Report for Application No. EP 17189257.3, dated Jan. 23, 2018 (3 pages).

*Primary Examiner* — Regina N Holder
(74) *Attorney, Agent, or Firm* — Nixon Peabody LLP

(57) ABSTRACT

A sound generator including a housing having a first wall portion with a housing opening, a shielding element covering at least a portion of the first wall portion and having a shield opening, where the shielding element covers a portion of the first wall portion.

17 Claims, 2 Drawing Sheets

(56) References Cited

U.S. PATENT DOCUMENTS

| | | | |
|---|---|---|---|
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 8,798,299 | B1 | 8/2014 | Higgins |
| 2011/0044485 | A1 | 2/2011 | Lin |
| 2011/0182453 | A1 | 7/2011 | van Hal |
| 2011/0189880 | A1 | 8/2011 | Bondo |
| 2011/0235837 | A1 | 9/2011 | Huttinger |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0064406 | A1 | 3/2013 | Miller |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |

* cited by examiner

SOUND GENERATOR, A SHIELDING AND A SPOUT

CROSS-REFERENCE TO RELATED APPLICATIONS

This application claims the benefit of European Patent Application Serial No. 17189257.3, filed Sep. 4, 2017, which is incorporated herein by reference in its entirety.

FIELD OF THE INVENTION

The present invention relates to a shielded sound generator as well as shielding elements for a sound generator. In particular, the invention relates to a better shielding of a sound generator where the shielding also at the sound output is improved.

BACKGROUND OF THE INVENTION

Technology of this type may be seen in U.S. Pat. No. 7,460,681, EP2375784, US2011/044485, WO2014090282 and U.S. Pat. No. 8,798,299.

In general, sound generators, such as receivers for hearing aids or hearables, are sources of electromagnetic radiation due to the AC current in the coil and displacement of the ferromagnetic armature in the airgap between two permanent magnets. Such a magnetic field may be picked up by nearby elements, such as a telecoil also placed in the hearing aid with consequent stability issues and feedback.

Especially in BTE and ITE applications, a telecoil will be positioned so close to the receiver that magnetic shielding made up of mu-metal is desired. In this type of design it has been found that the sound outlet and in some circumstances also the holes for the lead wires may be a key point, as the diameter of such holes can decrease the shielding performance due to the magnetic leak. A solution to this could be the increase of the shielding thickness but this will increase the size of the product.

SUMMARY OF INVENTION

In a first aspect, the invention relates to a sound generator comprising:

- a housing having a first wall portion with a housing opening,
- a shielding element covering at least a portion of the first wall portion and having a shield opening, the shielding element being positioned adjacent to the first wall portion, where:
- a sound outlet formed by an overlap, when projected on to a plane of the first wall portion, of an outline of the housing opening and an outline of the shield opening,
- the shield opening has, when projected on to the plane, an area being no more than 150% of an area of the sound outlet.

In the present context, a sound generator is an element configured to output sound. Often, sound generators have a diaphragm dividing an inner space of the housing into at least two chambers where one has a sound outlet or a housing opening. Then, a motor is used for driving the diaphragm and thus creating sound. Alternatively, the diaphragm may itself be movable, such as if made of a piezo electric material.

In one embodiment, the sound generator is a miniature sound generator, such as a sound generator with a largest dimension of no more than 10 mm, such as no more than 8 mm, such as no more than 6 mm or no more than 5 mm. In one situation, the sound generator housing may have a volume of no more than 100 $mm^3$, such as no more than 70 $mm^3$, such as no more than 50 $mm^3$, such as no more than 30 $mm^3$. Miniature sound generators may be used in hearing aids, hearables or personal hearing devices, such as ear phones or the like.

The housing opening may be an opening from an inner chamber or space of the housing to surroundings thereof. Usually, the housing will have only one or two openings from chamber(s) therein to the surroundings. One opening may be a pressure compensation opening which has dimensions not to any substantial degree transmitting frequencies above 20 Hz, such as above 10 Hz, such as above 5 Hz. The housing opening, however, preferably has a size transporting frequencies up to at least 10 kHz, such as up to at least 20 kHz.

Often, the first wall portion is plane so as to define a plane parallel thereto.

The shielding element covers at least a portion of the first wall portion and has a shield opening. The shielding element may additionally cover other portions of the housing, such as at least substantially all other portions of the housing.

In this respect, a portion of a housing is covered, if the shielding element overlaps the portion, such as when projected on to a plane of the portion of the housing. The covering relates to whether magnetic or electric field lines extending toward or through, such as perpendicular to, the first wall portion will be attenuated by the shielding element. Consequently, the shielding element may be positioned inside the housing, such as between first wall portion and any motor or other field generator in the housing. Then, the shielding element may block or attenuate fields from inside the housing before impinging on the first wall portion. Alternatively, the shielding element may be positioned on the outside of the housing so as to attenuate or block fields exiting the first wall portion.

In this context, as mentioned, the shielding is primarily a blocking or attenuation of electrical and/or magnetic fields. Materials suitable for such shielding may be different types of metals. The most preferred material is the so-called mu-metal.

Often, a hearing aid or hearable will comprise the sound generator as well as other elements, such as coils, microphones and the like, which will be sensitive to any magnetic or electric fields from the sound generator. All such elements may be provided inside an outer housing. Some prior art relate to this housing being shielding, but such shielding will not protect the inner elements from fields from the sound generator which is also provided in the outer housing.

The shielding may be affected by a number of parameters, such as the shielding capability of the shielding element material, a thickness thereof (in the direction of the fields, typically perpendicular to a plane of a surface) and dimensions/sizes of any openings therein. The shielding opening acts to allow sound to escape the generator, also through the housing opening, and thus is required. However, the size and dimensions of the shielding opening may be adapted to the desired shielding and the desired sound emission.

The sound outlet is formed by or defined as an overlap, when projected on to a plane of the first wall portion, of an outline of the housing opening and an outline of the shield opening.

The first wall portion and the shielding element are positioned adjacent to each other, such as abutting. Preferably, sound is not able to pass between the first housing part and the shielding element and escape the generator at other positions than through the sound outlet. Thus, any space between the shielding element and the first wall portion is either sealed so that no sound can pass from the housing opening to outside of the generator via that space and/or such space is so narrow that it will attenuate frequencies in the interval of 20 Hz-20 kHz by 3 dB or more. Naturally, the shielding element may be attached to the first wall portion, such as by gluing, welding, soldering or the like. Preferably, sound can only exit the housing through the common opening of the housing opening and the shield opening.

Preferably, the shield opening has a small cross section in order for the shield to perform the desired function. Preferably, the shield opening, when projected on to the plane, has an area being no more than 150% of an area of the sound outlet, such as no more than 130%, such as no more than 120%, such as no more than 110%, such as about 100%.

The area of the shield opening may optionally or additionally be compared to that of the housing opening. Thus, the outline of the shield opening may be no more than 150% of an area of an outline of the housing opening, in the cross section, such as no more than 130%, such as no more than 120%, such as no more than 110%, such as about 100%.

On the other hand, sound has to be able to escape the shield opening. Naturally, the shield opening may present a dampening of the sound output of the sound generator. The acoustic resistance of the shield opening usually is proportional to the thickness of the shielding element and inversely proportional to the cross section of the opening—with the power of 4, that is, R=t/S^4. Thus, by reducing the cross section by 0.5 there will be an increase in resistance, and hence damping, of 16 times the original value, with the same shielding element thickness.

The desired shielding of the shielding element is 3 dB or more. Different shielding materials need to have different thicknesses in order to achieve a certain degree of shielding. A thicker layer, however, will increase the size of the sound generator which usually is desired as small as possible.

The shielding degree of the complete sound generator also depends on the overall proportion of the sound generator which is actually shielded. In many products, an oblong product with a cuboid shape where the sound output and the terminals are provided on the end surfaces, only the larger side surfaces have been shielded, allowing electric/magnetic fields to escape the housing at the end surfaces.

Consequently, in addition to this shielding of the side surfaces not having the sound or housing output or elements (terminals and/or openings for wires to the motor), also a second wall portion (with terminals and/or openings for wires) may be shielded.

In fact, when a larger proportion of the housing is shielded, the overall thickness of the shielding element may be reduced in order to obtain the same, overall shielding efficiency. Thus, shielding additional surfaces or wall portions may in total achieve a smaller product.

In general, a portion of the housing is shielded, if the shielding element overlaps this portion when projected on to a plane of the portion. A proportion of the element shielded may be seen as a proportion of an outer surface of the housing which is covered or shielded.

In one embodiment, the sound generator further comprises a spout having a first opening and a second opening, the first opening being positioned so as to receive sound from the sound outlet, wherein the shield opening has a cross sectional area, when projected on to the plane, of no more than 50% of a cross sectional area of the second opening projected onto the plane.

Often, a spout has therein a sound channel between the two openings.

Naturally, the spout may comprise the shielding element, so that the generator housing may be that of a standard generator, the advantage of the shielding being brought about by the spout.

When the shield opening is smaller than the second opening, the shielding element extends into the second opening, at least in the projection, and thus may give a better shielding than if the spout itself was made of a shielding material.

The positioning of the first opening is so that sound exiting the sound opening will enter the spout and thus be guided by the spout. Preferably, the first opening at least partly overlaps the sound outlet, such as when at least 50% of the sound opening overlaps, in the projection, with the first opening. Preferably at least 60%, such as at least 70%, preferably at least 80%, such as at least 90% of the sound opening overlaps with the first opening in the projection.

Often, the first opening is larger than the sound opening in the projection so that the first opening does not itself generate undesired attenuation.

In another embodiment, the sound generator further comprises a spout positioned so as to receive sound from the sound outlet, the spout extending from the sound outlet and away from the housing, the spout having a portion having an outer shape configured to be attached to a sound guide and an inner contour at the outer shape and wherein the shield opening has a cross sectional area, when projected on to the plane, of no more than 50% of a cross sectional area of the inner contour projected onto the plane.

Usually spouts are used for not only guiding sound but also to attach a sound guide to the sound generator. A sound guide may be a tube, channel or the like. Situations also exist where the spout attaches the sound generator to other structures, such as a hearing aid or hearable housing or the like.

In order to be attached to the sound guide or other structure, the spout preferably has a portion, usually an outer portion (farthest away from the housing) which has a predetermined shape. Often, the desired shape is so that a portion of the length of the spout has a predetermined outer shape and size, such as a tubular shape with a desired outer diameter. In this manner, a corresponding tube or the like with the same, now inner, diameter may be translated along the spout and be kept in place simply by friction. The second opening may then be in this portion of the spout.

As mentioned, in one situation, the spout portion is tube-shaped, such as when it has the same cross section in a plane perpendicular to the longitudinal axis.

Preferably, for hearing aid or hearables, the spout portion has a length of at least 0.5 mm, such as at least 1 mm, such as about 1.6 mm and for example a diameter of about 1 mm.

In one embodiment, the shield opening is slit-shaped.

In that or another embodiment, the housing opening is slit-shaped.

In this connection, "slit-shaped" will mean oblong, such as when a longest dimension, in a plane of the shield element, is at least twice a dimension perpendicular to the longest dimension. Often, the longest dimension is at least 3 times, such as at least 4 times, such as at least 5 times larger than the extent in the perpendicular direction.

The outline of the housing and/or shield opening may be rounded, such as oval, or rectangular with rounded corners, for example.

One of the reasons for providing a slit-shaped shield and/or housing opening could be that the chamber into which the shield opening and/or the housing opening opens has a low height. Thus, an oblong opening may be required in order to have an opening with the desired area, in the cross section, into the chamber.

Often, it is desired that the shield opening is as small as possible. Thus, if the housing opening is defined by a shape of the chamber, it may be desired to provide a shield opening with at least substantially the same shape so as to have a high shielding with a rather low additional attenuation by the shielding element.

In some sound generator types, such as the Sonion 2600 receiver, the front chamber has a height of 0.28 mm and a width of e.g. 2.7 mm. Thus, the longer dimension of the opening may be 1.26 mm and the dimension perpendicular to this (in the height direction) may be selected at 0.26 mm. Providing a larger opening in the height direction would require increasing the size of the sound generator. Making the output wider is possible. If a spout is provided for collecting the sound output, this of course has to have corresponding dimensions.

In one embodiment, the shielding element comprises an end element comprising the shield opening and which is positioned between the first wall portion and the spout. This end element may be the complete shielding element or a part thereof. The end element may be fixed in a desired position by the spout when fixed to the housing. Thus, the spout may be fixed to the housing, such as by snap fitting, gluing or the like, and the end element may be kept in place by the attachment of the spout to the housing. Alternatively, the end element may be fastened itself to the housing or spout at or before attaching the spout to the housing.

In another embodiment, the shielding element comprises an end element comprising the shield opening and which is positioned inside the housing. In this situation, a standard spout e.g. may be used, and the outer dimensions of the sound generator housing need not be altered. On the other hand, the assembly process of the sound generator may need altering, as the inner housing now comprises the end element, so that it may be desired to e.g. fasten a diaphragm to the end element.

In one embodiment, the spout is present but not shielding to any degree, such as if the attenuation is less than 3 dB. Thus, the spout may be made of a material with a low thickness and/or a poorly attenuating material, such as aluminium, stainless steel or a polymer.

Alternatively, the spout may be made of a shielding material. Then, the shielding element may comprise the spout. In this situation, the spout may itself be made of a material and have a thickness which would attenuate an electric field and/or a magnetic field 3 dB or more.

Then, the shielding element may still extend, in the projection, inside the first opening of the spout so as to create additional shielding.

Alternatively or additionally, the spout may comprise a waist part between the first wall portion and the second opening or the spout portion, the waist having an opening forming the first opening or the shield opening. In this connection, a waist is a portion of reduced diameter, typically an inner diameter. In this situation, the waist portion generates, inside the spout, a narrowed portion which will increase the shielding of the spout. The narrowed portion may, compared to the second opening and/or the first opening, have an area, in the cross section, being 70% or less, such as 60% or less, such as 50% or less, than an area of the first or the second opening in the cross section.

A second aspect of the invention relates to a spout unit for use in or with a sound generator, such as the sound generator according to the first aspect, the spout unit comprising:

a spout channel extending along a longitudinal axis and having a first opening and a second opening and a shielding element positioned at the first opening, shielding element having a shield opening having a cross sectional area, when projected on to a plane perpendicular to the longitudinal direction, of no more than 50% of a cross sectional area of the second opening when projected onto the plane.

This aspect may be combined with any other aspect and embodiment above and below.

Preferably, the shield opening and the first opening have overlapping contours when projected on to the plane, so that sound may travel through these openings even if the shielding element abuts the first opening of the spout unit. In fact, the shield opening may form the first opening, when the shield is comprised in the spout. In this situation, the spout may be used in connection with a standard generator so as to bring about both the advantage of the spout and the advantage of the shielding. That assembly may then be added a shielding housing in which the generator housing may be positioned and with which the spout or shielding element fits so as to enclose the generator housing in a shielding enclosure formed by the shielding housing and the shielding element.

The spout unit may comprise an outer surface configured to, such as shaped to, engage and/or abut a transducer or sound generator housing, such as to snap fit to the transducer housing.

The spout may, at the second opening, have a portion, such as an elongated portion, which is configured to be attached to a sound channel, such as a tube, or another element configured to receive sound. This portion may be a portion having a desired cross section along a portion of a length from the second opening and along the longitudinal direction. Often, this portion has a desired outer circular shape configured to be provided inside a tube for fastening the tube to the spout.

The spout unit may be attached to a sound generator according to the first aspect. As mentioned above, the spout unit may be made of a shielding or a non-shielding material.

The shielding element may be permanently fastened to the spout channel or an element forming the spout channel. Alternatively, this element may have one or more elements configured to engage the shielding element and to fix the shielding element when the spout unit is fastened to a transducer housing.

The positioning of the shielding element in relation to a housing opening of a transducer may be as described above. This relative positioning may be defined by the portion of the spout unit configured to engage the housing.

A third aspect of the invention relates to a spout unit for use in a sound generator, such as the sound generator according to the first aspect, the spout unit comprising:

a spout extending along a longitudinal axis and having a first portion and a spout portion, the spout portion having an outer shape configured to be attached to a sound guide and an inner contour at the outer shape and a shielding element at the first end, the shielding element comprising a shield opening opening into the spout, the shield opening having a cross sectional area, when projected on to a plane perpendicular to the longitudinal axis, being no more than 50% of a cross sectional area of the inner contour projected onto the plane.

This aspect may be combined with any other aspect and embodiment above or below.

Clearly, the generator or transducer may be a standard generator with no shielding or no shielding at the first wall portion. All other features at the generator, such as the diaphragm, motor etc. may be as those described above.

The spout usually has therein a channel through the first portion and the spout portion. The spout unit may, at the first portion, have a shape, such as an outer surface, configured to engage, such as abut, a transducer housing. This engagement may be soldering, gluing, press fitting or the like.

The spout portion is configured to be attached to a sound guide or the like. A sound guide may, e.g., be a tube. The spout portion may have a pre-determined outer contour along its length, which may be a predetermined distance along a longitudinal axis of the spout unit. This outer contour may be oval or circular with desired outer dimensions.

In addition, the spout portion may have desired inner dimensions, such as an inner diameter of the channel, to guide sound sufficiently. This channel may have a first and a second opening as described above.

The positioning of the shielding element in relation to a housing opening of a transducer may be as described above. This relative positioning may be defined by the portion of the spout unit configured to engage the housing.

The shielding element may be permanently fastened to the spout channel or an element forming the spout channel. Alternatively, this element may have one or more elements configured to engage the shielding element and to fix the shielding element when the spout portion is fastened to a transducer housing.

A fourth aspect of the invention relates to a shielding element for use in the sound generator according to the first aspect, the shielding element being configured to be positioned adjacently to the first wall portion.

Preferably, the shielding element has a shield opening as described above, and this shielding element may be positioned, in relation to a housing opening of the sound generator, as described above.

The shielding element may be configured to be provided outside of the housing, such as to be attached to the housing. This attachment may be obtained if the shielding element itself has portions, such as an outer surface, configured to attach to the housing. Alternatively, the shielding element may be attached to the housing using another element, such as a spout unit as described above.

Alternatively, the shielding element may be configured to be positioned inside the housing. In this situation, the shielding element preferably is flat and has an outer contour, in a plane thereof, conforming to a contour of an inner surface, or a part of an inner surface, of the housing. In one situation, the shielding element is configured to cover an inner surface of the housing, where a housing opening is made in the housing for allowing sound to escape the housing. In another situation, the shielding element is configured to cover a part of the inner surface, such as a portion of the inner surface on one side of a diaphragm of the housing, such as a wall portion in which a housing opening is provided.

A fifth aspect of the invention relates to an assembly of a sound generator and a spout, wherein:

the sound generator comprises a housing having a first wall portion with a housing opening, the spout being made of a shielding material and having:

a first portion engaging the first wall portion, the first portion comprising a first opening positioned so as to receive sound from the housing opening, a spout portion, being positioned, relative to the first portion, farther away from the sound generator, the spout portion comprising a second opening, wherein the spout comprises a waist part between the first portion and the spout portion.

Naturally, this aspect of the invention may be combined with any of the above and below aspects, embodiments and the like.

Preferably, the first portion of the spout engages the first wall portion in a manner so that sound cannot escape from the housing opening to surroundings of the assembly by other routes than through the waist portion and the second opening.

Preferably, the spout covers, when projected on to a plane of the first wall portion, an area of the first wall portion exceeding a total area, in that projection, of the first wall portion subtracted 200%, such as 150%, such as 100% of the area of the housing opening in the projection.

BRIEF DESCRIPTION OF THE DRAWINGS

In the following, preferred embodiments will be described with reference to the drawing, wherein.

DETAILED DESCRIPTION OF THE INVENTION

Figure 1:
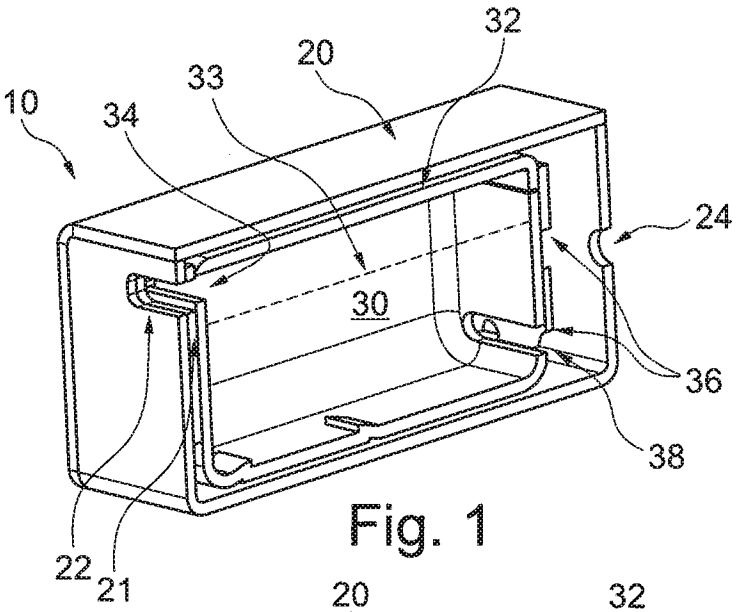
FIG. 1 illustrates a first embodiment of a sound generator according to the invention.

In FIG. 1, a sound generator 10 is illustrated comprising an outer shielding housing 20 and a sound generator 30 provided therein. Naturally, the housing 32 of the generator 30 could be made of the shielding material, but that is often not desired.

The sound generator housing 32 has a housing opening 34, in a first wall portion 21, and a sound generating motor (not illustrated) usually comprising a magnet system, a coil and a membrane moved by the magnet/coil, such as via an armature, when the coil is supplied with a current. Sound generated in the housing 32 is output via the opening 34. In order to supply the motor, terminals 36 are provided on the outer side of the housing 32, and an opening 38 is provided for wires connecting the terminals 36 to the motor.

The shielding housing 20 has a shield opening 22 through which sound exiting the housing opening 34 may exit the generator 10. The openings 22 and 34 together form a sound output.

The shielding housing 20 also comprises an opening 24 for allowing power/signal supply to the terminals 36 of the sound generator.

Optimal shielding of the sound generator 30 is desired in order to not have magnetic or electric fields from the generator 30 influence other components in the vicinity. In one example, the generator 10 is provided in a hearing aid housing or hearable housing together with sensitive elements, such a coils or the like. In such situations, it is desired to provide the shielding on or around the sound generator and not those elements.

The openings 22 and 34 are oblong. The shape of the openings may be selected based on a number of factors such as a shape of the sound generator chamber from which the sound is to be output.

In many embodiments, a diaphragm, indicated by the dashed line 33, of the sound generator divides the inner space of the housing 30 into two chambers, a front chamber (above the diaphragm) and a back chamber (below the diaphragm). When the front chamber has a low height, the shape and dimensions of the opening 34 has corresponding limitations. As the sound intensity output naturally depends on the size of the opening, a larger opening and thus a larger sound output intensity may be achieved by making the opening 34 oblong with a largest dimension parallel to the diaphragm plane.

The overall sound output of the generator 10 will be the overlap between the opening 34 and the opening 22. Thus, in order to have both a large sound output intensity and a good shielding, it is preferred that the shapes and positions of the openings 34 and 22 are about the same. A larger opening 22 may not increase the sound output intensity, if the opening 34 (projected on to a plane of the surface in which the opening is present) lies within the opening 22. However, that could reduce the shielding of the generator 10.

In the same manner, a larger opening 34 may not increase the sound output intensity, if the opening 22 (projected on to a plane of the surface in which the opening is present) lies within the opening 34. However, that would not affect the shielding of the generator 10 to any substantial degree.

Figure 2:
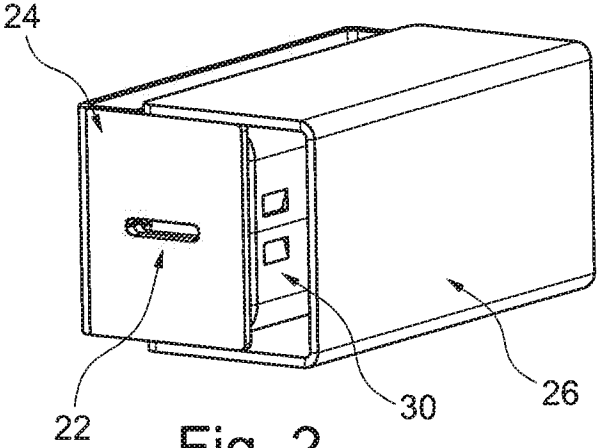
FIG. 2 illustrates second embodiment of a sound generator according to the invention.

FIG. 2 illustrates a particular manner of obtaining the shielding housing 20, i.e. providing it as two parts, 24 and 26, inside which the generator 30 may be provided. The two parts may be assembled so form the final shielding housing 20.

Figure 3:
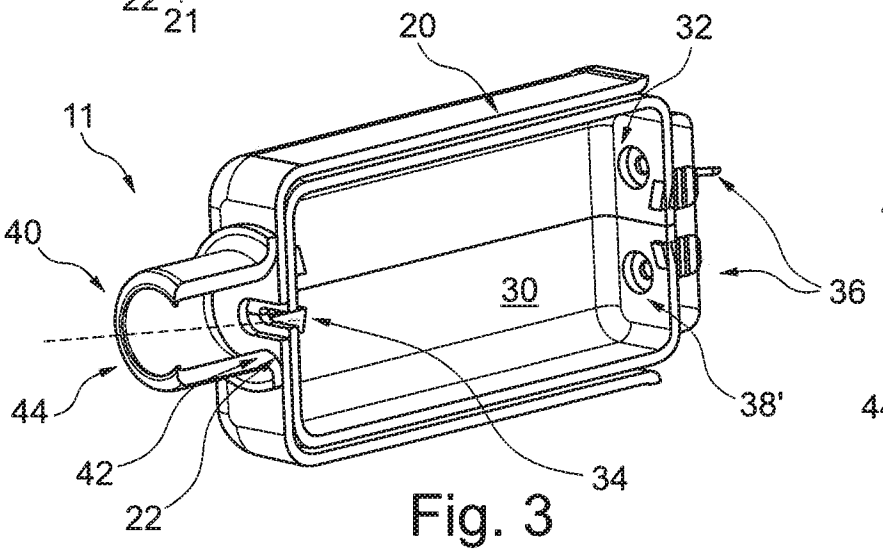
FIG. 3 illustrates a third embodiment of a sound generator according to the invention.

FIG. 3 illustrates and embodiment 11 where the same elements have the same numbers as in FIG. 1 with the exception that in FIG. 3, a back portion of the shielding housing 20 has not been illustrated and that the openings 34/22 are positioned centrally on the left housing and shielding walls.

In FIG. 3, the generator 11 has a spout 40 into which sound from the openings 34/22 is output. The spout has an input opening 42 and an output opening 44 and a sound channel there between along a longitudinal axis (hatched line).

Often, spouts are provided to facilitate connecting the generator 11 to sound guides, such as tubes/channels which may be connected to the spout by providing the spout at least partly within the tube/channel to form a sound proof connection between the generator 11 and the tube/channel.

Often, at least the outermost (leftmost) portion of the spout has a well defined cross section (being tubular with the same, often circular, cross section along the portion) so that it may be attached to the sound tube/channel. However, as may be seen in FIG. 4, other portions, such as the innermost (rightmost) portion, may have other shapes.

Often, the spout 40 is formed integrally with the generator housing, such as the housing 20 or the housing 30. Alternatively, the spout may be attached thereto and may thus have, at the input end 42, a surface configured to conform to the generator housing and which may be attached thereto, such as by gluing, welding, snap fitting or the like.

The spout 40 may be made of a shielding material, but this it not required, as the shielding extends to within the opening 42 in FIG. 3. Thus, the fact that the shielding extends to, when projected on to a plane of the left wall portion of the housing 20 or the housing 30, within the inner circumference of at least the opening 44 of the spout, the shielding housing 20 itself provides an improved shielding, even if the spout itself is not shielding.

Figure 4:
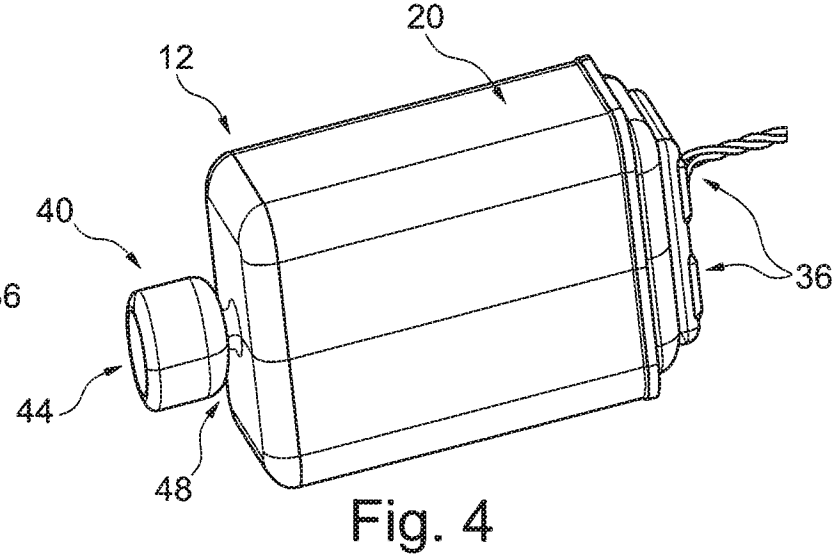
FIG. 4 illustrates a fourth embodiment of a sound generator according to the invention.

In FIG. 4, a generator 12 is illustrated seen from the side. In this embodiment, the spout 41 is integral with the shield housing 20 and has a waist 48 close to the housing wall. This waist thus defines the shield opening. The shield housing 20 is, in this embodiment, open at the opposite end of the spout. This is merely a design choice. In an alternative, the shield housing may cover only the front surface 21 of the generator if desired.

Figure 5:
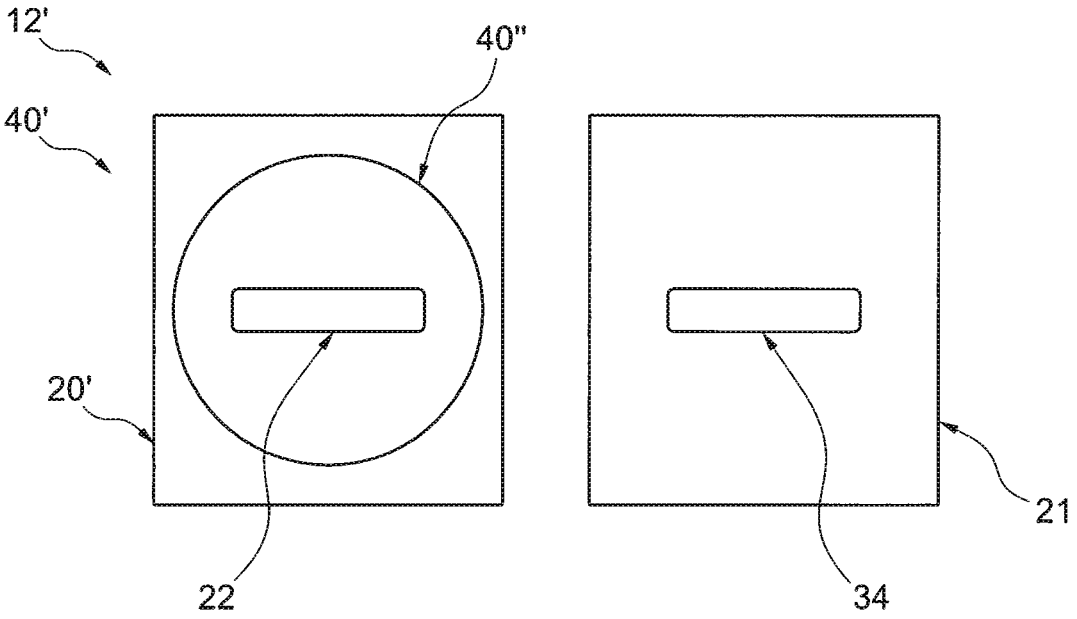
FIG. 5 illustrates a standard receiver with a shielded spout.

In FIG. 5, a generator 12' is seen comprising (disassembled), to the right, a sound generator with a first wall portion 21 and a slit-shaped housing opening 34 and, to the left and seen from the front, a spout 40' comprising a tube-shaped portion 40" and a shielding portion 20' with a slit-shaped shield opening 22.

It is noted that the shielding portion 20' is configured to shield all of the first wall portion 21 in the same manner as the shielding in e.g. FIG. 1. Thus, the sound generator 12' may be a standard unshielded generator. The shielding portion 20' may extend even farther, such as when bent and also extending along at least a portion of the length of the generator 12' so as to also shield part of (or all of) the side portions of the generator.

Clearly, the tube-shaped portion 40" may also be shielding. Then, the portion of the shielding 20' inside the tube-shaped portion 40" may be replaced by a non-shielding material—or no material at all. This shielded tube-shaped portion 40" may then the slit-shaped opening 22 at its far end or have the waist 48 to increase its shielding.

Figure 6:
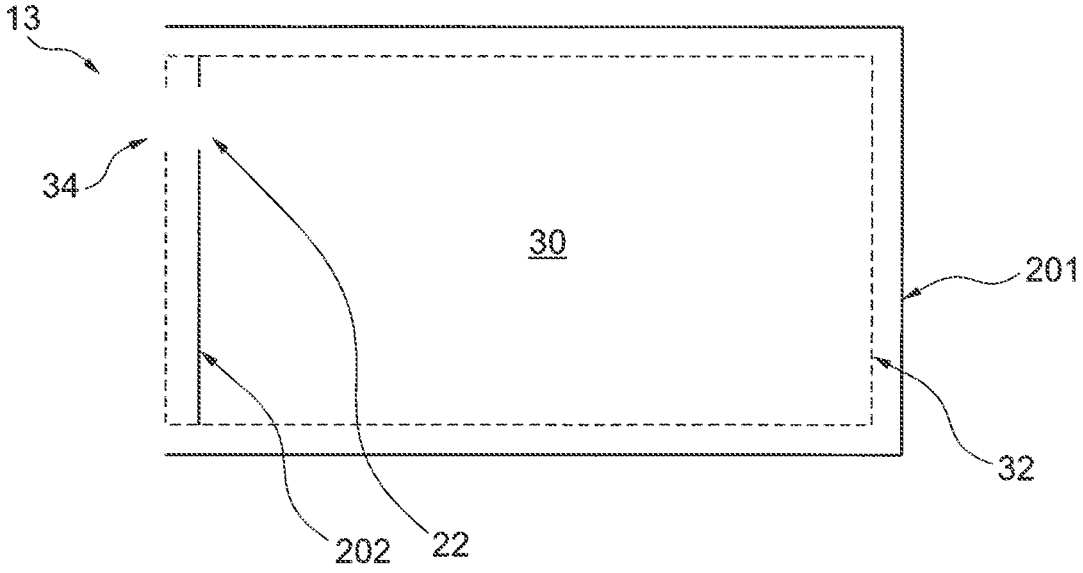
FIG. 6 illustrates a fifth embodiment of a sound generator according to the invention.

In FIG. 6, a generator 13 is seen having an alternative shape and position of the shielding, where a back shielding portion 201 is provided within which the generator 30 is positioned. However, the back portion 201 is open at the front, left, side of the housing 32, where the housing opening 34 is positioned. To shield also the front side, a shielding end element 202 is provided wherein the shield opening 22 is provided. The element 202 is provided inside the generator housing 32.

In general, the shield may be made of a metal, such as mu-metal 80-20. The shielding effect naturally depends not only on the size(s) of the opening(s) 22/24 but also the thickness of the shielding material. For miniature generators, a thickness of about 0.130 mm is preferred with a housing thickness of about 140 μm.

The desired attenuation is 3 dB or more, and the minimum thickness for usual mu-metal materials is about 50 μm, but primarily due to thinner layers being difficult to handle.

The present sound generator 10, 11, 12, 13 may be used in e.g. a hearing aid, hearable, personal hearable, ear phone or the like and thus preferably is a so-called miniature receiver.

The invention claimed is:

1. A sound generator comprising:

a housing having a first, plane, wall portion with a housing opening, a shielding element, for shielding against electrical and/or magnetic fields, covering at least a portion of the first wall portion and having a shield opening, the shielding element being positioned adjacent to the first wall portion, where:

a sound outlet formed by an overlap, when projected on to a plane of the first wall portion, of an outline of the housing opening and an outline of the shield opening, the shield opening has, when projected on to the plane, an area being no more than 150% of an area of the sound outlet.

2. A sound generator according to claim 1, further comprising a spout having a first opening and a second opening, the first opening being positioned so as to receive sound from the sound outlet, wherein the shield opening has a cross sectional area, when projected on to the plane, of no more than 50% of a cross sectional area of the second opening projected onto the plane.

3. A sound generator according to claim 2, wherein the spout portion is tube-shaped.

4. A sound generator according to claim 2, wherein the spout portion has a length of at least 0.5 mm.

5. A sound generator according to claim 2, wherein the shielding element comprises an end element comprising the shield opening and positioned between the first wall portion and the spout.

6. A sound generator according to claim 2, wherein the spout is made of a shielding material.

7. A sound generator according to claim 6, wherein the spout comprises a waist part between the first wall portion and the spout portion, the waist having an opening forming the shield opening.

8. A sound generator according to claim 2, wherein the shielding element comprises the spout.

9. A spout unit for use in the sound generator according to claim 2, the spout unit comprising:

a spout channel extending along a longitudinal axis and having a first opening and a second opening and a shielding element positioned at the first opening, shielding element having a shield opening having a cross sectional area, when projected on to a plane perpendicular to the longitudinal direction, of no more than 50% of a cross sectional area of the second opening when projected onto the plane.

10. A spout unit for use in the sound generator according to claim 2, the spout unit comprising:

a spout extending along a longitudinal axis and having a first portion and a spout portion, the spout portion being configured to be attached to a sound guide and having an inner contour, and a shielding element comprising a shield opening opening into the spout, the shield opening having a cross sectional area, when projected on to a plane perpendicular to the longitudinal axis, being no more than 50% of a cross sectional area of the inner contour projected onto the plane.

11. A sound generator according to claim 1, wherein the shield opening is slit-shaped.

12. A sound generator according to claim 1, wherein the shielding element comprises an end element comprising the shield opening and positioned inside the housing.

13. A sound generator according to claim 1, wherein the housing opening is oblong.

14. A shielding element for use in the sound generator according to claim 1, the shielding element being configured to be positioned adjacently to the first wall portion.

15. A shielding element according to claim 14, wherein the shielding element is configured to be positioned inside the housing.

16. A sound generator comprising:

a housing having a first wall portion with a housing opening, a spout having a first opening and a second opening, the first opening being positioned so as to receive sound from the sound outlet, wherein the shield opening has a cross sectional area, when projected on to a plane of the first wall portion, of no more than 50% of a cross sectional area of the second opening projected onto the plane and a shielding element covering at least a portion of the first wall portion and having a shield opening, the shielding element being positioned adjacent to the first wall portion, where:

a sound outlet formed by an overlap, when projected on to the plane, of an outline of the housing opening and an outline of the shield opening, the shield opening has, when projected on to the plane, an area being no more than 150% of an area of the sound outlet and the shielding element comprises an end element comprising the shield opening and positioned between the first wall portion and the spout.

17. A sound generator comprising:

a housing having a first wall portion with a housing opening, a spout having a first opening and a second opening, the first opening being positioned so as to receive sound from the sound outlet, wherein the shield opening has a cross sectional area, when projected on to a plane of the first wall portion, of no more than 50% of a cross sectional area of the second opening projected onto the plane and a shielding element covering at least a portion of the first wall portion and having a shield opening, the shielding element being positioned adjacent to the first wall portion, where:

a sound outlet formed by an overlap, when projected on to the plane, of an outline of the housing opening and an outline of the shield opening, the shield opening has, when projected on to the plane, an area being no more than 150% of an area of the sound outlet and the spout is made of a shielding material.

* * * * *